US008696420B2

(12) United States Patent
Mueller et al.

(10) Patent No.: US 8,696,420 B2
(45) Date of Patent: Apr. 15, 2014

(54) SYSTEM AND METHOD FOR COUNTING SWIMMING LAPS

(76) Inventors: Neal Mueller, San Francisco, CA (US); Kyle Doerksen, Mt. View, CA (US)

( * ) Notice: Subject to any disclaimer, the term of this patent is extended or adjusted under 35 U.S.C. 154(b) by 0 days.

(21) Appl. No.: 12/837,920

(22) Filed: Jul. 16, 2010

(65) Prior Publication Data

US 2012/0245714 A1 Sep. 27, 2012

Related U.S. Application Data

(60) Provisional application No. 61/226,356, filed on Jul. 17, 2009.

(51) Int. Cl.
*A63F 9/24* (2006.01)

(52) U.S. Cl.
USPC ..... 463/4; 700/141; 700/91; 702/162

(58) Field of Classification Search
USPC ..... 463/4; 700/91, 141; 702/162
See application file for complete search history.

(56) References Cited

U.S. PATENT DOCUMENTS

| | | | | |
|---|---|---|---|---|
| 5,136,621 | A * | 8/1992 | Mitchell et al. | 377/24.2 |
| 2005/0186542 | A1 * | 8/2005 | Roncalez et al. | 434/247 |
| 2008/0018532 | A1 * | 1/2008 | Mackintosh et al. | 342/357.12 |
| 2011/0153042 | A1 * | 6/2011 | Burton et al. | 700/91 |

* cited by examiner

*Primary Examiner* — Pierre E Elisca
(74) *Attorney, Agent, or Firm* — Kolisch Hartwell, P.C.

(57) ABSTRACT

The invention can be worn by the swimmer and comprises a sensor module, preferably with a digital compass and accelerometer, preferably worn under a swim cap or attached to goggles, and a human interaction device, preferably integrated into or worn as wrist watch, for displaying laps. The sensor module and the human interaction device are in communication with each other, preferably via wireless communication. A microprocessor with software is included in either the sensor module, watch or both. The microprocessor/software interprets data from a digital compass and digital accelerometer within the sensor to determine when the swimmer has changed directions and thereby count the number of laps. The watch can then display the number of laps.

6 Claims, 4 Drawing Sheets

SYSTEM AND METHOD FOR COUNTING SWIMMING LAPS

CROSS-REFERENCE TO RELATED APPLICATIONS

The present application claims the benefit of U.S. Provisional Application No. 61/226,356 filed on Jul. 17, 2009, which is incorporated herein by reference.

STATEMENT REGARDING FEDERALLY SPONSORED RESEARCH OR DEVELOPMENT

The present invention was not developed with the use of any Federal Funds, but was developed independently by the inventors.

BACKGROUND OF THE INVENTION

Swimmers that practice in pools generally have a need to keep track of the number of laps that they swim in a pool. It is also desirable to keep track of the time it takes to swim each lap as well as a series of laps.

For short swims it is relatively easy for the swimmer to keep track of the number of laps she has swum herself. However, on longer training swims, where a swimmer may swim tens or hundreds of laps, it is difficult for the swimmer to keep track of his count. When training with a coach, the coach may keep track of the laps and the time elapsed (or even individual lap times), however most swimmers do not have the luxury of a full time coach, and in any event this can be tedious for the coach (or friend/family member).

An automated system is needed to automatically count laps for a swimmer. Such systems have been proposed such as in U.S. Pat. No. 6,870,466 to Rust et al. Rust teaches a system wherein a sensor is placed in the water at one end of the pool. The swimmer wears a device that can communicate with the sensor when they are in close proximity. Thus each time the swimmer approaches the end of the pool, the worn device comes into proximity with the sensor and a lap is counted.

BRIEF DESCRIPTION OF THE INVENTION

The invention can be worn by the swimmer and comprises a sensor module with a digital compass and accelerometer, preferably worn under a swim cap or attached to goggles, and a human interaction device, preferably integrated into or worn as wrist watch, for displaying laps, and preferably time elapsed and/or lap time. The sensor module and the human interaction device (hereafter referred to as "watch") are in communication with each other, preferably via wireless communication. A microprocessor with software is included in either the sensor module, watch or both. The microprocessor/software interprets data from a digital compass and digital accelerometer within the sensor to determine when the swimmer has changed directions and thereby count the number of laps. The watch can then display the number of laps. Preferably, the swimmer controls the start and end of counting as well as any other necessary or necessary controls through the watch, although it could also be done through the sensor module.

DETAILED DESCRIPTION OF THE INVENTION

Figure 1:
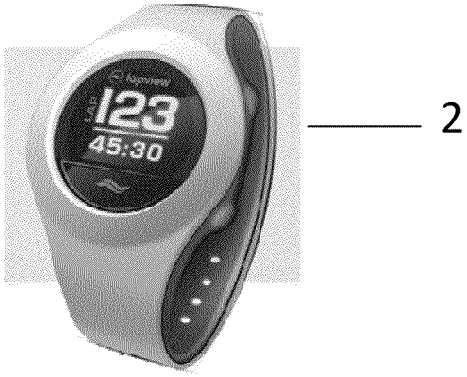
FIG. 1 shows a human interaction device 2 in the preferred embodiment of a watch.
Figure 2:
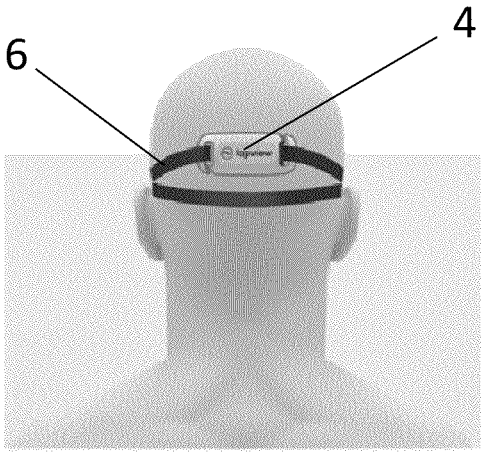
FIG. 2 shows a sensor module 4 in the preferred embodiment worn attached to goggle straps behind the head.

The purpose of the present invention is to count laps for swimmers. The compass-based sensor module 4 counts laps for swimmers by tracking the swim direction. Each length the swimmer swims is identified by recognizing an approximately 180 degree change in direction of the swimmer. In one embodiment of the invention, the lap counter increments once for every two lengths.

At the beginning of the swim the swimmer switches a button on the sensor module 4 to the "on" position and presses start on the watch 2. The watch 2 may delay for a short period of time to allow the swimmer to begin swimming, and then runs the method described herein to count laps. In an alternative embodiment the sensor module 4 and watch 2 are in "sleep" (low power) mode and automatically turn on when the swimmer begins swimming. While in the described preferred embodiment the human interaction device 2 is integrated into a watch, it is not necessary the "watch" look like a traditional watch at all. Any human to computer interface can be used, but it should be waterproof and wearable. Obviously, the existence of waterproof digital watches makes the watch a suitable interface. Similar interfaces already exist for GPS based running systems. However, the use of the term "watch" is not meant to limit the human interaction device 2 to any particular form.

In one embodiment of the invention, the system has two components, a watch 2, and a sensor module 4. The sensor module 4 preferably sits inside the cap or attached to the goggle strap 6 of the swimmer and transmits a radio signal to the watch 2. The sensor module 4 sends lap increments to the watch 2. In one preferred embodiment the radio signal is approximately 2.4 GHz, but this frequency may be changed.

Figure 3:
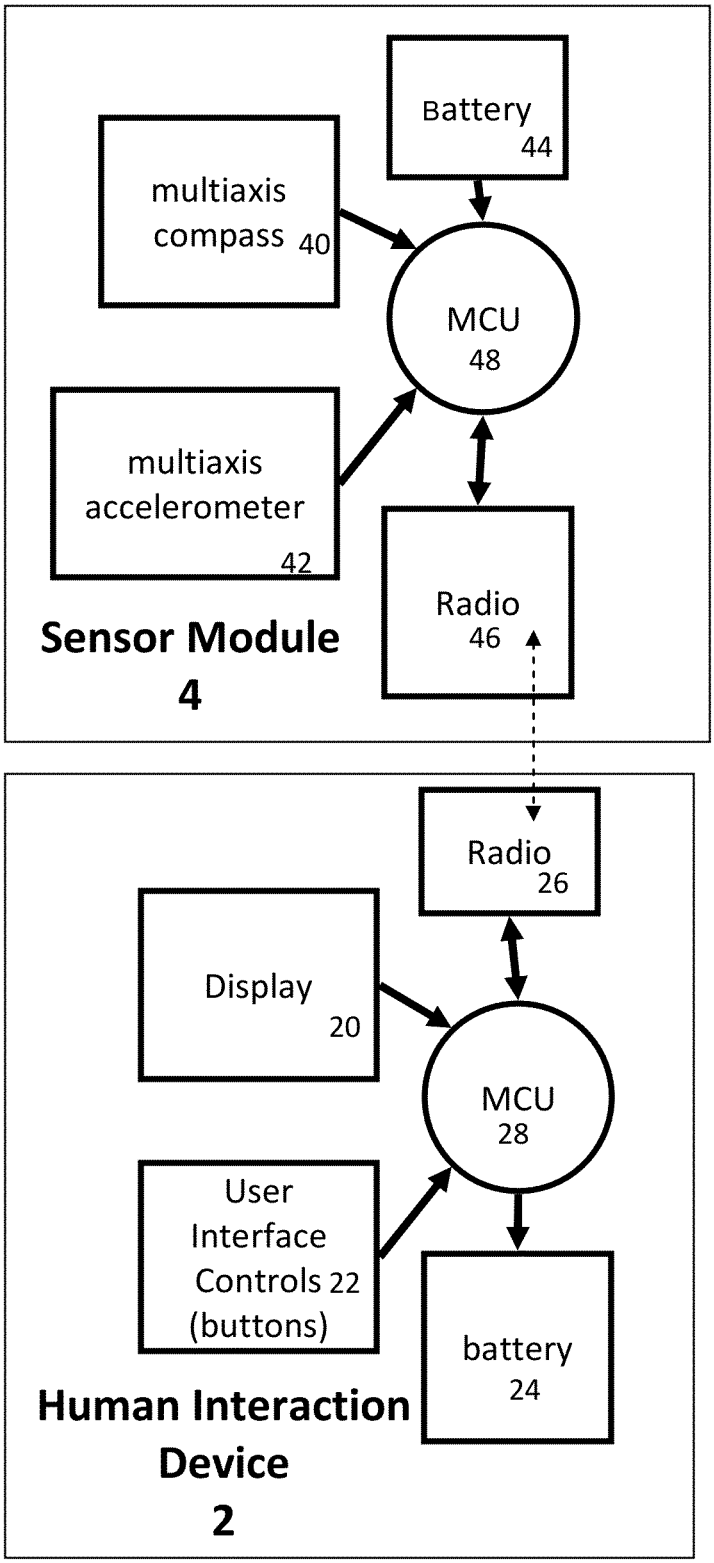
FIG. 3 shows a block diagram of one embodiment of the invention showing both the sensor module 4 and the watch 2.

In one preferred embodiment of the invention the watch 2 is comprised of (FIG. 3):

Waterproof housing (not shown)
Radio device 26
Battery (rechargeable or non-rechargeable) 24
Microcontroller (MCU) 28
Display 20
User Interface Controls 22

In one preferred embodiment of the invention the sensor module 4 is comprised of (FIG. 3):

Slim waterproof sensor housing (not shown)
On/off button (not shown)
Digital compass (2 or 3 axis magnetometer) 40
Accelerometer and/or gyros 42
Compass tilt-compensation algorithm (not shown)
Signal processing algorithm (not shown)

Operating software stack (not shown)
Microcontroller (MCU) 48
radio device 46
Battery (chargeable or non-chargeable) 44

In another embodiment of the invention, the core sensor components include an accelerometer (2 or 3 axis, MEMS), a gyroscope, a tilt-compensation algorithm, a signal processing algorithm, a 2.4 GHZ ISM band radio, and a battery (rechargeable or non-rechargeable).

Sensor location on swimmer: A location on the goggle strap or under the swim-cap is preferable. An alternate location would be on the swimmer's ankle, back or waist. These locations are chosen because in no swimming stroke do these parts of the body change direction approximately 180 degrees relative to the direction of the swimmer's motion, which is our method for detecting laps. By contrast, a sensor mounted on a swimmer's wrist during the freestyle stroke would change direction radically during each stroke, and variations in different swimmer's strokes would make it difficult to determine a lap count accurately. However, the method described herein include and may be applied to a wrist based sensor module, the only drawback being additional complexity in the data filtering methodology and the corresponding additional computational power required. The advantage to a wrist based sensor module 4 is that the sensor module 4 and the human interaction device 2 can be integrated into a single device, preferably a watch.

Figure 4:
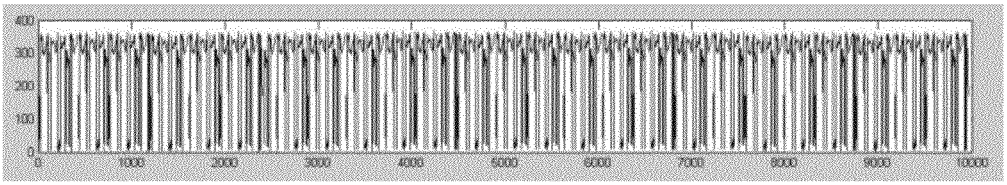
FIG. 4 shows a graph raw data derived from the digital compass.
Figure 9:
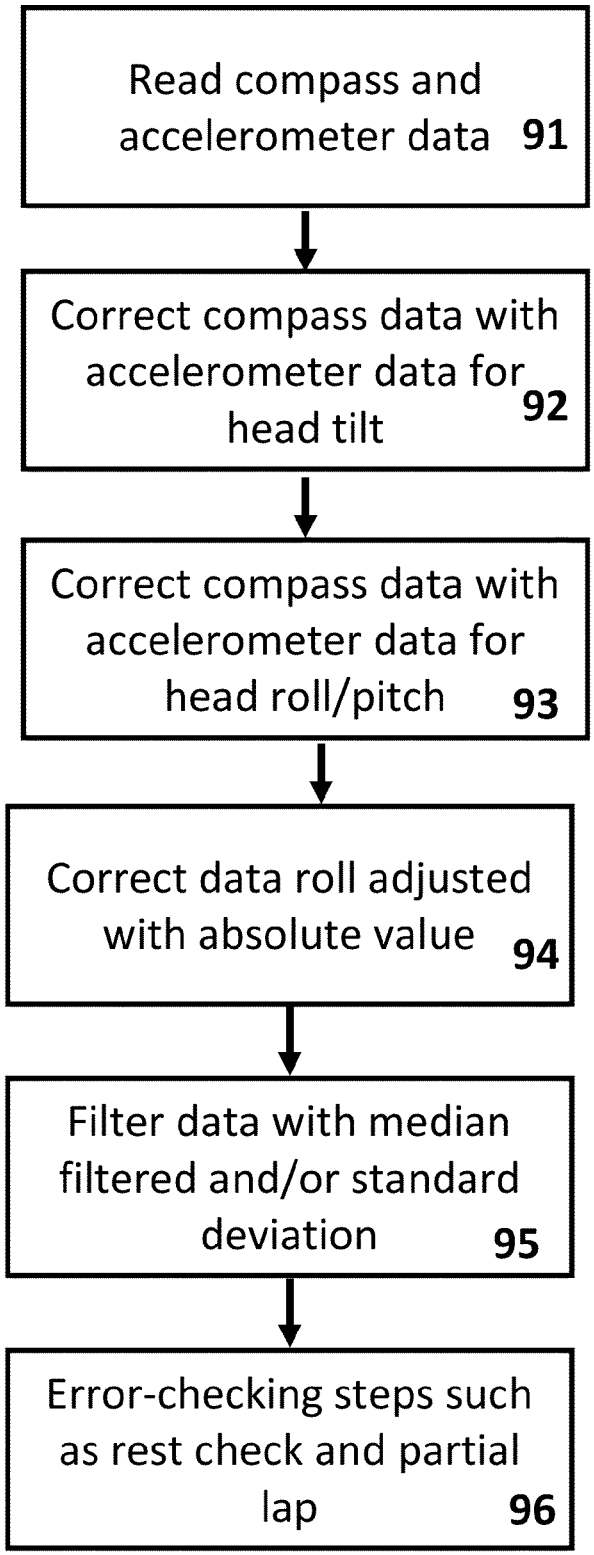
FIG. 9 shows a flow chart of the hardware/software method used in the present invention.

FIG. 9 is a flow chart of the method for implementing the present invention:

Step 1: Raw data from the digital compass 40 and the accelerometer 42 is read 91 into the microcontroller 48. The raw compass data from the magnetometer 40 is erratic in its raw form (FIG. 4). This noise is caused primarily by the tilt and roll/pitch of the swimmer in the water. As with any compass, this compass is accurate only when the compass is held level with respect to the ground, or it is with this invention, when it is compensated for tilt and roll/pitch.

A note on the graphs: the following five graphs plot the data that is collected and processed by the core components of the sensor (listed above). The data in these graphs is real and was collected by the sensors as an actual swimmer swam in a multi-lane lap-swimmer pool. The graphs are time-series line-plot graphs. The x-axis is time. The y-axis is a sensor readout that represents the cardinal direction of the swimmer. The data from the sensor is processed live as the swimmer swims. Algorithmic computations adjust the data so it can be used to count laps accurately.

Figure 5:
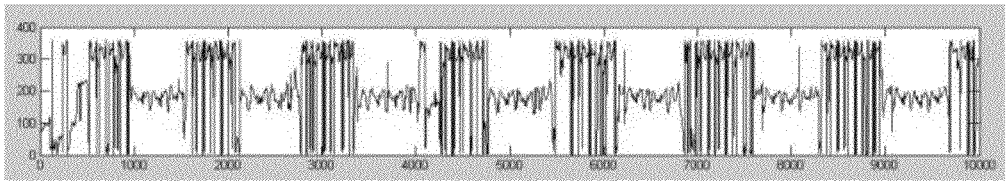
FIG. 5 shows the data of FIG. 4 corrected using additional data from an accelerometer.

Step 2: Next the raw compass data is filtered using data from the accelerometer is to adjust for the tilt of the swimmer's head during the swim (i.e. lifting chin up and down). The inventors have found that a useful way to accomplish this is by use of the gravity vector from multi-axis accelerometer 42 to compensate magnetometer vector (from the compass 40) for the fact that magnetometer sensor 40 is not oriented parallel to the ground. We can see the structure of the data is taking shape in FIG. 5. The wide bands of data represent the swimmer traveling in one direction and the narrow bands of data represent the swimmer traveling in the opposite direction.

Figure 6:
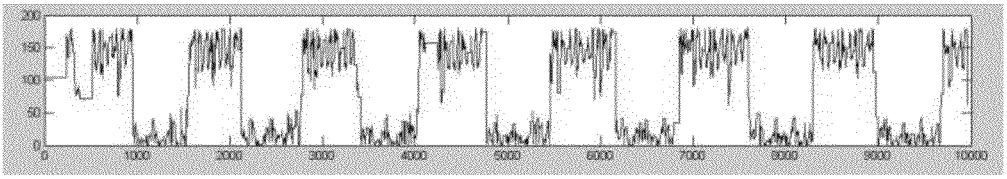
FIG. 6 shows the data of FIG. 5 roll adjusted with absolute value.

Step 3: The next step is to adjust for the roll/pitch (i.e. side-to-side) of the swimmer's head during the swim 93. Even with the tilt-compensation algorithm described in step 2, values at extreme head turn angles should not be trusted. If the roll/pitch angle exceeds a specified value, the algorithm uses the last compass value that had an acceptable amount of roll/pitch. The inventors have found that it is desirable to identify periods of reliable heading data (i.e. opportunistic sampling) by ignoring times when the roll/pitch exceeds a threshold of 30-degrees (in the preferred embodiment), or the roll/pitch rate exceeds 100-degrees per second (in the preferred embodiment). The degree thresholds (30 degrees and 100 degrees per second) will vary by implementation. We also take the absolute value of abs(180-corrected Heading) 94 so that heading values that are close to each other are mathematically close to each other, which is not the case with the compass heading system (0 degrees and 359 degrees are physically similar but numerically different). The results of the roll/pitch adjustment and taking the absolute value are shown in FIG. 6.

Step 4: With FIG. 7 we have an algorithmically robust way to count laps with live data. The data from FIG. 6 has been median filtered 95 using a sliding window median filter of approximately 3 seconds in length. The vertical lines are algorithmically detected points in time when the swimmer is changing direction. Every vertical line indicates a length the swimmer has completed, and each set of two vertical lines indicates a lap of the pool from one end to the other, and back. Because the sliding window is short and the above algorithm is not computationally intensive it can be implemented in real-time on a low-cost microprocessor with limited RAM and processing performance.

Figure 8:
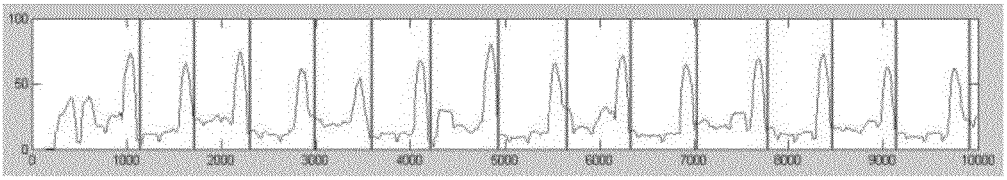
FIG. 8 shows an alternative to the algorithm of FIG. 7 detecting laps from the data in FIG. 6 using standard deviation techniques.

FIG. 8 shows an alternative method to identify laps. Once the compass heading data has been tilt compensated and filtered, the standard deviation of a sliding window of the data is computed. If the swimmer is swimming, then the heading will be very consistent since the heading is theoretically exactly the same number with each measurement. However, if they are changing direction doing a flip turn, the standard deviation of the windowed heading data will be high because it will contain their initial heading, their new heading approximately 180 degrees opposite, and a range of other values during the turn itself.

Figure 7:
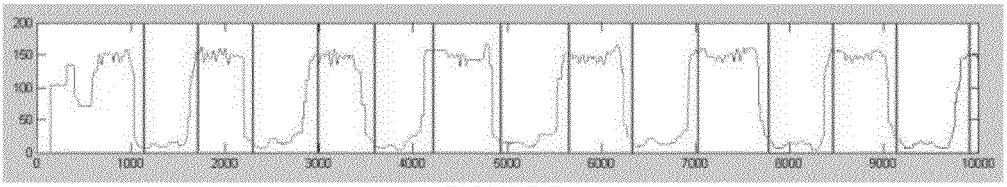
FIG. 7 shows the data of FIG. 6 median filtered in final form for counting laps.

Obviously once the time for each change of direction has been detected, as shown in FIG. 7 or 8, it becomes a trivial calculation to determine the time of each lap, the number of laps swum, average lap speed, etc. If the length of the pool is known, absolute speed can also easily be calculated.

The algorithm includes interim error-checking steps to prevent certain activities, such as resting, from being misinterpreted by the algorithm 96.

Rest check: This prevents a rest from being misidentified as a lap. If the head is vertical, as opposed to facing up or down or to the side, the algorithm enters a rest state. If the user begins swimming again within a few seconds, the algorithm continues counting laps as normal. If not, the watch beeps and the user can press a button on the watch to continue swimming. This user confirmation step increases the accuracy and user-friendliness of the watch by not inadvertently stopping lap counting.

Partial lap: This prevents severely partial laps from being misidentified as a lap. If the lap time is 16 seconds (much faster than the world record lap time) or less it will not be counted as a lap.

In one embodiment of the invention the inventors have used the following standard commercially available parts: Microcontroller 48 DEV-08614; Compass 40 SEN-07915 magnetometer; Triple Access Accelerometer 42 SEN-00252; and Radio/Antenna 46 NRF24AP2. These are provided by way of example and are not meant to limit the invention in any way. These parts are constantly improving and becoming smaller and lower power and all such improvements are meant to be within the scope of this invention. Similarly some or all of these parts may be implemented in integrated units and such improvements are within the scope of the invention.

In the preferred embodiment the algorithm does not require the user to identify whether the pool is oriented North-South or East-West, etc. Instead it looks for periods of time when the heading data suggests the swimmer is swimming in a particular direction, and then periods of time when the heading is approximately 180 degrees opposite.

In the preferred embodiment the processing of the algorithm described above occurs in the sensor. The processing of the algorithm, however, can be moved to the watch if that is determined to be preferable. In either case the source data comes from the sensor and is displayed in the watch.

The preceding hardware and software example is only meant to be illustrative and is not meant to be limiting. Indeed, many types of sensors may be used. For instance, for outdoor swimming a GPS receiver may be used in an alternative embodiment. Functions may be implemented in hardware, software or firmware. Many types of algorithms may be used to further clean up the raw data from the sensor. Likewise one or more microprocessors may be used in the sensor and/or watch.

While the inventors have found it convenient to implement the human interface and sensor and separate modules the invention may be implemented in a single module as well. The single module could be worn on the waist so easily accessed, or also integrated into a watch, given sufficient algorithms and processing power to filter out noise generated by arm movement. In a preferred embodiment additional sensors to detect biometric data such as heart and breathing rates are integrated with the system and displayed and stored using the human interface. In the preferred embodiment the system stores data for multiple swim sessions and is capable of downloading this information to a general purpose computer using industry standard interfaces such as blue tooth or wifi or USB port. Interfaces to other specialized computer devices such as telephones or MP3 players may also be desirable.

In another embodiment of the invention the sensors could be used to provide information other than lap count and speed. For instance, the raw data may be analyzed to lap time, count strokes, calories burned, speed, and swimming efficiency. Data may be instantaneous or stored and averaged. The raw or processed sensor data could all be stored and offloaded to a computer for later detailed analysis

We claim:

1. A lap-counting device worn by a swimmer comprising:

a sensor comprising a compass having a magnetometer that generates a heading output and an accelerometer that generates a gravity vector, the sensor being wearable by a user;

a human interface device in communication with the sensor, the human interface device comprising a display and being wearable by the user; and a controller integrated into the sensor or human interface device, the controller being in communication with both the sensor and human interface device, the controller generating a compensated heading output by using the gravity vector from the accelerometer to adjust the heading output of the compass, the controller calculates a lap count based on the compensated heading output, wherein the lap count is communicated to the display.

2. The lap-counting device according to claim 1 wherein the accelerometer is a multi-axis accelerometer or a multi-axis gyroscope.

3. The lap-counting device according to claim 1 wherein the controller uses the gravity vector from the accelerometer to adjust for the tilt of the compass during.

4. The lap-counting device according to claim 1 wherein the controller uses the gravity vector from the accelerometer to adjust for the roll/pitch of the compass during swimming.

5. The lap-counting device according to claim 1 wherein the controller filters using a sliding window median filter.

6. The lap-counting device according to claim 1 wherein the human interface device is integrated into a wrist watch.

* * * * *

UNITED STATES PATENT AND TRADEMARK OFFICE

CERTIFICATE OF CORRECTION

PATENT NO. : 8,696,420 B2
APPLICATION NO. : 12/837920
DATED : April 15, 2014
INVENTOR(S) : Neal Mueller and Kyle Doerksen It is certified that error appears in the above-identified patent and that said Letters Patent is hereby corrected as shown below:

In the Claims

Column 6, line 30, Claim 3 after “compass”:, delete “during”

Signed and Sealed this
Eighth Day of July, 2014

Michelle K. Lee

Michelle K. Lee
*Deputy Director of the United States Patent and Trademark Office*